US005139454A

United States Patent [19]

Earnest

[11] Patent Number: 5,139,454

[45] Date of Patent: Aug. 18, 1992

[54] GREETING CARD WITH MOVABLE PARTS

[76] Inventor: Michael L. Earnest, 310 - 13th St., Huntington Beach, Calif. 92648

[21] Appl. No.: 765,692

[22] Filed: Sep. 25, 1991

[51] Int. Cl.[5] ..... A63H 33/00; A63H 33/38; A63H 29/22; G09F 1/10

[52] U.S. Cl. ..... 446/150; 446/14; 446/484; 40/463; 40/124.1

[58] Field of Search ..... 446/14, 149, 150, 151, 446/152, 148, 147, 484, 485, 342, 343; 40/416, 463, 124.1

[56] References Cited

U.S. PATENT DOCUMENTS

| | | | |
|---|---|---|---|
| 2,749,657 | 6/1956 | Lohnes | 446/150 |
| 3,740,543 | 6/1973 | Frane | 446/485 X |
| 3,798,806 | 3/1974 | Sanford | 40/124.1 X |
| 3,918,180 | 11/1975 | Chamberlin | 446/151 X |
| 4,055,014 | 10/1977 | Schmidt et al. | 40/463 X |
| 4,244,140 | 1/1981 | Kim | 446/14 |
| 4,363,081 | 12/1982 | Wilbur | 446/147 X |
| 4,559,583 | 12/1985 | Ku | 40/124.1 X |
| 4,683,669 | 8/1987 | Greer, Jr. | 40/463 X |
| 5,013,276 | 5/1991 | Garfinkel | 446/14 |

FOREIGN PATENT DOCUMENTS

| | | | |
|---|---|---|---|
| 1378883 | 3/1988 | U.S.S.R. | 446/149 |

*Primary Examiner*—Danton D. DeMille
*Assistant Examiner*—D. Neal Muir
*Attorney, Agent, or Firm*—Poms, Smith, Lande & Rose

[57] ABSTRACT

A battery operated animated greeting card is disclosed which includes a display portion which is animated when the card is opened. The card includes a circuit board activated by batteries, with a wire of a titanium-alloy material activated by the circuit board to contract to move a portion of the display portion.

15 Claims, 3 Drawing Sheets

GREETING CARD WITH MOVABLE PARTS

BACKGROUND OF THE INVENTION

1. Field of the Invention

The invention relates to greeting cards; and, more particularly, to an animated greeting card.

2.Description of the Prior Art

Greeting cards are quite popular. Such cards generally have an appropriate writing or the like which is visible when the card is opened. In recent years, animated cards have become popular wherein a portion of the card is moved when the card is opened. There is a need for a greeting card which is electronically activated to animate a portion of the card when it is opened. Such card should be activated for a long period of time so as to retain its novelty and operate until all suitable conditions.

SUMMARY OF THE INVENTION

It is an object of this invention to provide an improved animated greeting card.

It is a further object of this invention to provide an animated greeting card that can selectively move a portion of a display on the card.

It is another object of this invention to carry out the foregoing objects using a wire of a titanium-nickel alloy activated by a pulsed electric current to move the animated portions of the card.

These and other objects are preferably accomplished by providing a battery operated animated greeting card which includes a display portion which is animated when the card is opened. A wire of a titanium-nickel alloy is activated to contract to move the animated portion of the card.

DESCRIPTION OF THE PREFERRED EMBODIMENT

Figure 1:
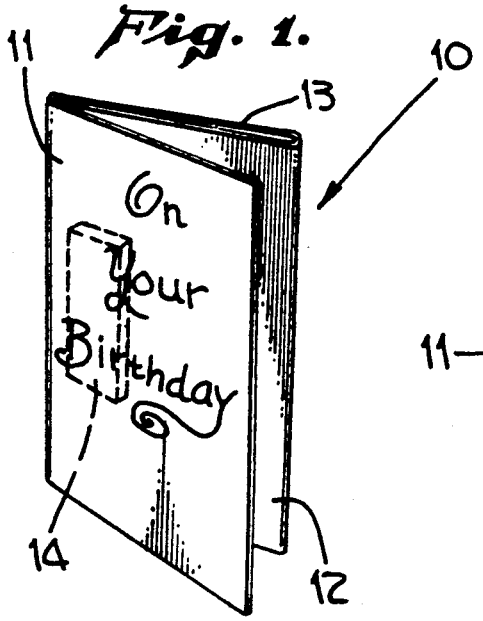
FIG. 1 is a perspective view of a greeting card in accordance with the invention shown in folded or closed condition.
Figure 2:
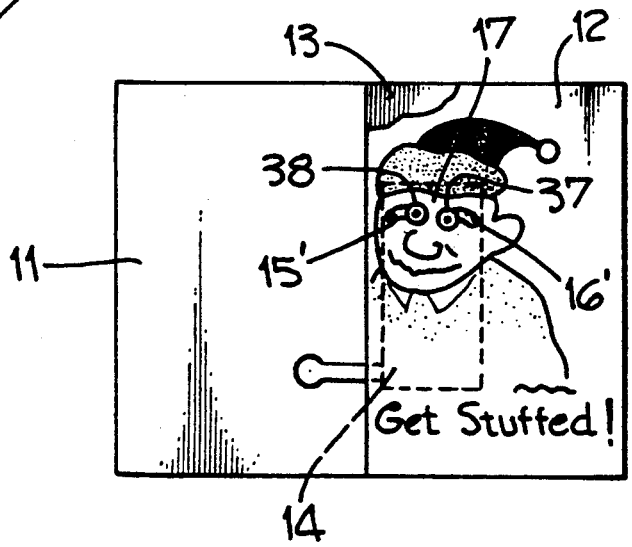
FIG. 2 is a plan view of the card in open position.
Figure 3:
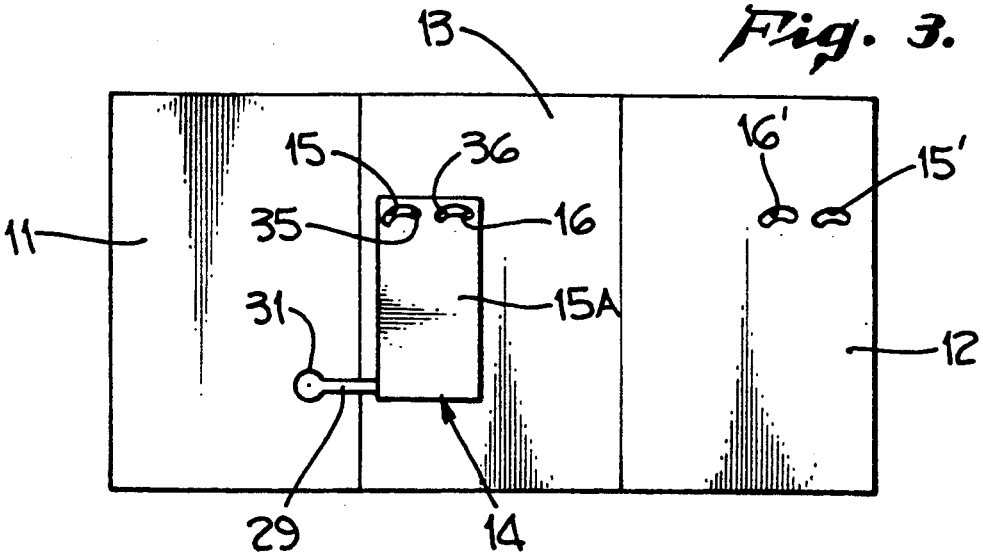
FIG. 3 is a plan view of the card of FIG. 1 in a fully open position, one of the leafs being detached from another of the leafs.

Referring now to FIG. 1 of the drawing, a greeting card 10 is shown having at least a front cover 11, a back cover 12 (see FIG. 3) and a middle portion 13. As seen in FIG. 3, actuating means 14 is provided on the middle portion 13 (see also the dotted line in FIG. 1). As seen in FIG. 2, back cover 12 is normally folded over on to middle portion 13 and is glued or otherwise secured thereto. Thus, actuating means 14 is sandwiched between back cover 12 and middle portion 13 as seen in dotted lines in FIG. 2.

Back cover 12 has a plurality, such as two, of spaced arcuate slots 15', 16' extending therethrough for reasons to be discussed. Slots 15', 16' correspond to like slots 15, 16, respectively, in housing 15A (FIG. 3), as will be discussed. A pictorial display, as for example, a face 17, (FIG. 2) may be provided on back cover 12. As seen in FIG. 2, the area of face 17 where the eyes would appear coincide with slots 15', 16'.

Figure 4:
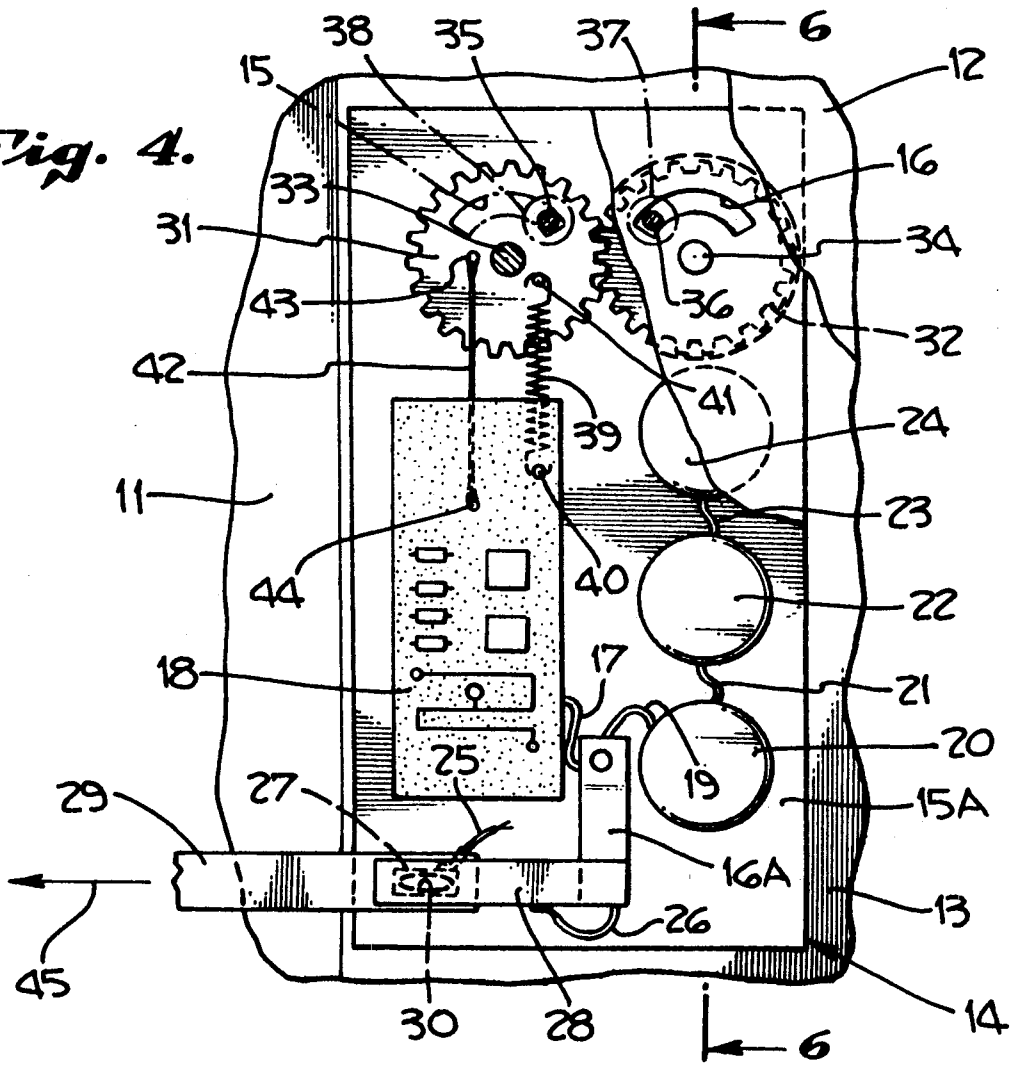
FIG. 4 is a plan view, partly schematic, of the actuating means alone of the card of FIGS. 1 to 3.

Actuating means 14 is shown in detail in FIG. 4. Actuating means 14 includes a housing 15A having a conventional switch 16A thereon electronically coupled via conduit 17 to an electronic timing circuit 18. Switch 16A is also electronically coupled by a conduit 19 to a conventional round battery 20, such as a watch battery. Any suitable batteries and number thereof may be used. For example, battery 20 may be electronically coupled via conduit 21 to a second similar battery 22 which is in turn coupled via conduit 23 to a third similar battery 24.

Figure 5:
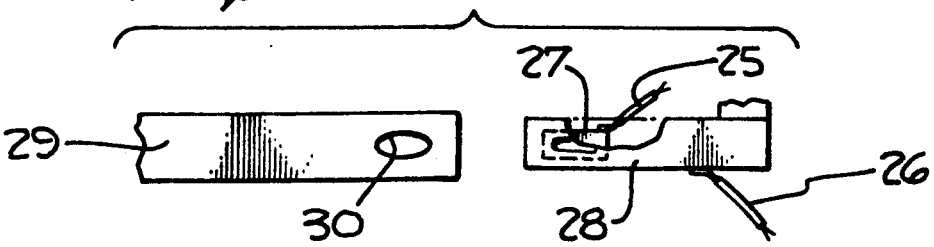
FIG. 5 is an exploded view of a portion of the actuating means of FIG. 4.

Switch 16A is also electronically coupled via conduits 25, 26 to a pair of spaced electrically conductive contacts 27, 28, respectively (see FIG. 5). A spacer 29 is provided in the form of an elongated strip of a suitable non-conductive material, such as plastic, having a hole 30 (which may be oval) therethrough. Spacer 29 is secured at one end 31 (FIG. 3) to the inside of front cover and normally extends between contacts 27, 28. That is, the non-apertured portion of spacer 29, when card 10 is folded as in FIG. 1, is disposed between the contacting portions of contacts 27, 28 thereby inactivating switch 16. When card 10 is opened, as in FIG. 2, opening 30 moves between the contacting portions of contacts 27, 28 thereby activating switch 16A until card 10 is closed again to the FIG. 1 position.

Figure 6:
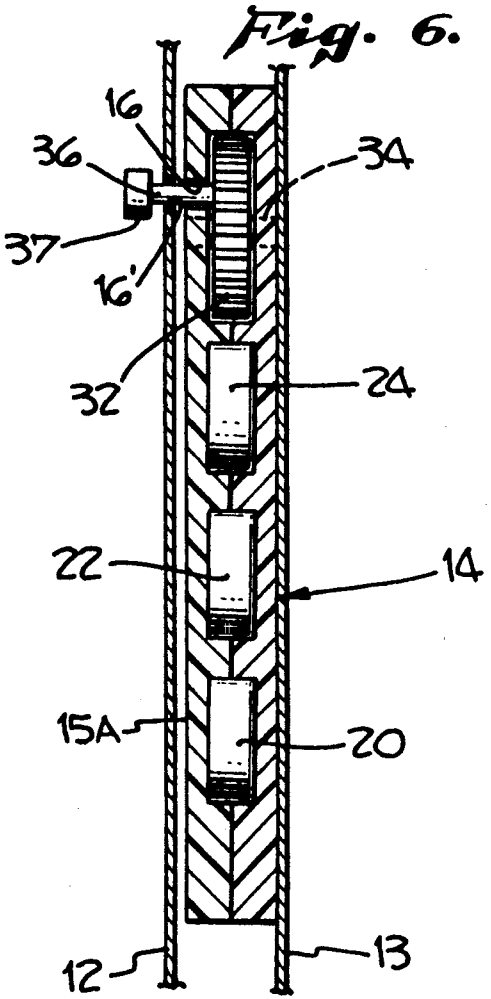
FIG. 6 is a view taken along lines 6—6 of FIG. 4.

A pair of gears 31, 32 (FIG. 4) are rotatably mounted on posts 33, 34, respectively, mounted on housing 15A. Each gear 31, 32 has a shaft fixed thereto, such as shafts 35, 36, respectively, (see FIGS. 3 and 6) extending through slots 15, 16 in housing 15A and slots 15', 16' in back cover 12 terminating in a member (members 37, 38, respectively—see also FIG. 2) simulating a part of the indicia of face 17 (such as the eyes thereof). Shaft 35 is not visible in FIG. 6.

A coil spring 39 is fixed at one end 40 to circuit board 18 and at the other end 41 to gear 31. A rigid wire 42 is fixed at one end 43 to gear 31 and at the other end 44 is electronically connected to circuit board 18.

Wire 42 is of a bio-metallic material, such as an alloy of nickel titanium. When an electrical current is applied to such a material, it contracts. One such material is sold under the trademark Flexinol by Dynalloy, Inc. of Irvine, Calif. This material is sold by Dynalloy as small wires which contract much as muscles do when electrical current is applied. These wires contract approximately 4.5% of their length with extremely high force for such a small size. The wires can selectively contract and return to normal in millions of cycles with little change in performance. Such wires are relatively stiff and may be about 0.006 inches or so in diameter. The wire herein may be between about 0.003 to 0.010 inches in diameter and of any suitable length. For example, a 1 inch long wire of about 3 mil diameter can be activated by a pulsed current of about 0.75 volts at 6 ohms.

In operation, card 10 is normally closed as in FIG. 1. When card 10 is opened as in FIG. 2, strip 29 is pulled in the direction of arrow 45 (FIG. 4). This moves opening 30 between the contacts 27, 28 activating switch 16A, thereby supplying power via batteries 20, 22, 24 to circuit board 18. This applies current to relatively stiff wire 42 when contracts thereby pulling gear 31. This simultaneously rotates gear 32 due to the meshing of the gears 31, 32. The members 37, 38, connected to gears 31, 32 via shafts 35, 36 move along arcuate slots 15', 16' thus simulating eye movement.

Current is selectively delivered or pulsed to wire 42 so that it contracts, then expands, spring 39 returning gear 31 to the FIG. 4 position, then contracts again so that members 37, 38 move back and forth.

Other than wire 42, which must be of a material that contracts upon application of an electrical current, and returns to normal after electrical current is ceased, any suitable materials may be used. Also, obviously any suitable parts of a design may be animated. For example, indicia 17 of face may be a suitable scene with parts thereof animated. Although a pair of spaced arcuate slots 15, 16, and a pair of shafts 35, 36 are disclosed, obviously only a single aligned slot and shaft is necessary to carry out the invention. Of course, any number of shafts and slots may be provided.

Obviously, any suitable types of batteries may be used, such as small round watch batteries. Any suitable printed circuit board may be used having a pulse forming circuit thereon for selectively applying a pulsed electrical signal to wire 42.

Figure 7:
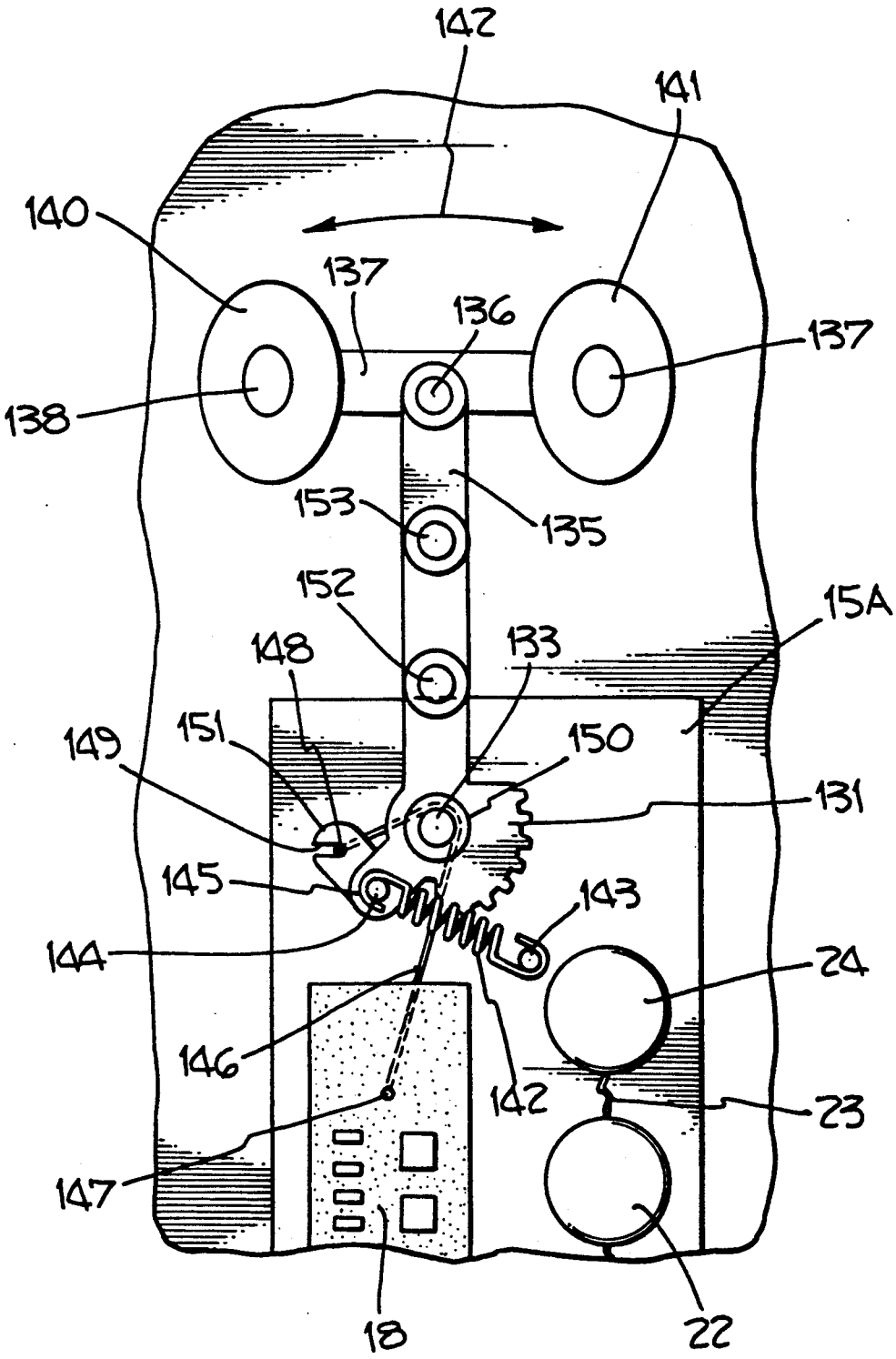
FIG. 7 is a plan view of a modification of the actuating means of FIGS. 1 to 6.

Although a pair of meshing gears are disclosed in FIGS. 1 to 6, which may be used to split or separate animated parts, such as the heart disclosed in my copending U.S. patent application Ser. No. 07/726,836, filed Jul. 8, 1991, the teachings of which are incorporated herein by reference, obviously a single idler arm can be used to animate a single piece. Thus, as seen in FIG. 7, wherein like parts refer to like parts of the embodiment of FIGS. 1 to 6. Thus, housing 15A includes thereon a single gear 131, shown as being toothed but could of course be smooth in its outer periphery, rotatably mounted on post 133 mounted to housing 15A. Gear 131 includes an integral elongated arm 135 having a shaft 136 at its terminal end. Shaft 136 is fixed to a cross-piece 137 which includes shafts 138, 139 fixed to each end (extending axially normal to the longitudinal axis of cross-piece 137). It is to be understood that shafts 138, 139 extend out of slots 15, 16 (see FIG. 3) and have simulated eyes 140, 141 (shown in dotted lines in FIG. 7—similar to members 37, 38 in FIG. 2) mounted thereon which move back and forth, as indicated by arrow 142, when arm 135 is rotated.

A coil spring 142 is fixed at one end to a post 143 on housing 15A and at the end to a post 144 on an arm 145 integral with gear 131. A rigid wire 146, of the same material and characteristics as wire 42, is fixed at one end 147 (and electronically coupled thereto) to circuit board 18. Wire 146 wraps about post 133 (retained thereon by washer 150) and hooks into, at end 148, a slot 149 in an arm 151 (similar to the coupling in my aforementioned application Ser. No. 07/726,836).

The operation of the mechanism of FIG. 7 is identical to that of the embodiment of FIGS. 1 to 6 except that, when contracted, wire 146 pulls arms 151 which in turn rotates gear 131 thereby moving eye members 140, 141. If desired, a plurality of posts, such as parts 152, 153 for like movement when arm 135 is rotated via being integral with gear 131.

Although a card has been described, any suitable display can be moved or animated in accordance with the teachings of the invention. Various modifications may occur to an artisan and the invention is to be limited only by the scope of the appended claims.

I claim:

1. A greeting card comprising:

a front planar cover panel;

a back planar cover panel having at least one opening therethrough;

an intermediate planar panel interconnecting said front and back panels; and animation actuating means mounted on a base plate sandwiched between said back panel and said intermediate panel having at least a pair of interengaged movable members mounted thereon, said actuating means having at least one movable element extending through said at least one opening in said back panel for relative movement therewith, said actuating means further including a relatively straight rigid wire having one end fixed to one of said members adapted to contract upon the application of an electrical current thereto and pulsed electronic means engaging said wire adapted to selectively apply pulsed electrical current to said wire thereby contracting said wire pulling said one of said members thereby moving both said one of said members and the other of said members interengaged therewith moving said movable element connected thereto, said wire having a diameter of about 0.006 inches and being of a nickel-titanium alloy.

2. In the device of claim 1 including said actuating means having a second movable element thereon, said second moveable element being coupled to at least one of said members for relative movement therewith and extending through another opening through said back panel.

3. In the device of claim 2, including indicia on said back panel, said openings therethrough being aligned on said indicia with said elements simulating a movable array on said indicia, each of said elements being movable simultaneously when actuated by application of said electrical current.

4. In the device of claim 1 wherein each of said movable members includes a gear portion in meshing relationship with the gear portion of the other of said members, and an elongated shaft integral with said gear portion, at least one of said shafts being interconnected to said movable element.

5. In the device of claim 1 wherein said movable members are spring biased.

6. In the device of claim 1 wherein said wire is between about 0.003 to 0.010 inches in diameter.

7. In the device of claim 1 wherein said wire is about 3 mil in diameter and about 1 inch in overall length.

8. In the device of claim 1 including a switch mounted on said base plate electrically coupled to said electronic means.

9. In the device of claim 8 wherein said switch includes an elongated strip having one end secured to said front panel and the other end extending to a pair of spaced contacts of said switch normally holding said contacts in a non-electronically engaged manner until said front panel is moved.

10. In the device of claim 9 wherein said strip is of an electronically non-conductive material having an opening therethruogh, said strip being normally disposed between said contacts in a first position on said front panel until said front panel is moved to a second position whereby the opening in said strip is moved between said contacts thereby bringing said contacts into contact until said front panel is returned to its first position.

11. In the device of claim 8 including battery means associated with said electronic means for powering said electronic means.

12. A greeting card having:

a front cover, a back cover, and an intermediate panel interconnecting said front cover to said back cover, said back cover being normally folded over onto said intermediate panel and secured thereto, said front cover being normally secured thereto, said front cover being normally folded over onto said back cover, said back cover having at least one opening therethrough;

a base plate sandwiched between said back cover and said intermediate panel;

a movable element mounted on said base plate extending from said base plate through said opening;

a rotatable member mounted on said base plate connected to said movable element;

pulsed electronic means associated with said base plate adapted to deliver a pulsed electrical current; an a relatively rigid straight wire adapted to contract when contacted by an electrical current coupled at one end to said electronic means and at the other end to said rotatable member, said wire having a diameter of about 0.006 inches and being of a nickel-titanium alloy.

13. In the device of claim 12 including a switch having a pair of spaced contacts electronically coupled to said electronic means, an elongated strip connected at one end to said front cover and at the other end extending to said contacts normally maintaining said contacts in a non-contacting relationship until said front cover is folded away from said back cover thereby pulling said strip connected thereto bringing said contacts into contacting relationship.

14. In the device of claim 12 wherein said rotatable member is a gear having an elongated arm, said movable element being coupled to said arm.

15. In the device of claim 14 wherein said gear is rotatable mounted on a shaft extending from said base plate, said wire wrapping about said shaft and coupled to an arm integral with said gear.

* * * * *